United States Patent [19]

Askew et al.

[11] Patent Number: 5,028,838

[45] Date of Patent: Jul. 2, 1991

[54] GRID ASSEMBLIES FOR USE IN CATHODE RAY TUBES

[76] Inventors: Dennis D. Askew, 437 SE. 15th, Gresham, Oreg. 97080; Donald C. Bomberger, 22555 SW. Boones Ferry Rd., Tualatin, Oreg. 97062; Conrad J. Odenthal, 1308 SE. 76th Ave., Portland, Oreg. 97215

[21] Appl. No.: 401,208

[22] Filed: Aug. 31, 1989

[51] Int. Cl.[5] ..... H01J 29/46; H01J 9/18

[52] U.S. Cl. ..... 313/456; 313/451; 313/482; 445/34

[58] Field of Search ..... 313/444, 447, 448, 449, 313/451, 456, 482; 445/34

[56] References Cited

U.S. PATENT DOCUMENTS

| | | | |
|---|---|---|---|
| 3,983,442 | 9/1976 | Jariwala et al. | 313/451 |
| 4,500,809 | 2/1985 | Odenthal et al. | 313/456 |
| 4,607,187 | 8/1986 | Villanyi | 313/414 |
| 4,672,276 | 6/1987 | Odenthal et al. | 315/382 |
| 4,720,654 | 1/1988 | Hernqvist et al. | 313/414 |

*Primary Examiner*—Donald J. Yusko
*Assistant Examiner*—Diab Hamadi
*Attorney, Agent, or Firm*—John D. Winkelman; Ann W. Speckman

[57] ABSTRACT

An integrated grid (G1/G2) assembly having enhanced mechanical strength and rigidity is provided for use in an electron gun assembly of a cathode ray tube (CRT). In the integrated grid assembly, the first and second grids (35 and 40, respectively) are fixed in relationship to one another, both axially and radially, by means of an insulating element (50) and a collar element (55). Brazed joints are preferably provided at the interface of the insulating element (50) with the second grid (40) and the collar element (55) to enhance the mechanical strength and rigidity of the assembly. An integrated grid (G1/G2)/anode assembly may be provided by mounting anode assembly (45) fixedly with respect to second grid (40) by means of second insulating element (60) and second collar element (65). Methods for assembling the integrated grid assemblies are also disclosed.

18 Claims, 3 Drawing Sheets

GRID ASSEMBLIES FOR USE IN CATHODE RAY TUBES

Technical Field

The present invention relates generally to methods and apparatus for providing cathode ray tube (CRT) display images having increased intensity and resolution by reducing deflection and distortion of the electron beam in the electron gun assembly of the CRT.

BACKGROUND ART

FIG. 1 schematically illustrates a magnetically deflected cathode ray tube (CRT) of a type which is known in the art. The CRT generally comprises a funnel-shaped portion 21 which terminates in phosphor screen 25, and a cylindrical neck portion 11 housing electron gun apparatus 10. Electron gun apparatus 10 generates and focuses an electron beam to produce a luminous image on the phosphor screen. Cathode 12 emits a stream of electrons forming electron beam 15, which successively passes through apertures in first grid 14 and second grid 16. Thereafter, the electron beam passes through an aperture at one end of anode cylinder 18, and it typically traverses a series of beam focusing and/or correction members 20. For example, a series of wafer electrodes may be provided to correct astigmatism produced by nonuniformities in the electromagnetic deflection field, as taught in U.S. Pat. No. 4,672,276. Electron beam 15 subsequently traverses focus electrode 22 and magnetic deflection yoke 24 and finally impinges o and illuminates the phosphor screen. An important objective in many CRT applications is to generate an electron beam providing a high intensity, sharply focused illuminated spot over the entire CRT screen. To achieve this objective, the electron beam must traverse the electron gun and funneling portion of the CRT without deviating from the desired beam path.

The present invention is directed to the electron gun portion of the CRT apparatus. First and second grids 14 and 16, respectively, have voltages applied thereto. Changes in the voltages applied to the cathode and the first grid with respect to one another vary the magnitude of electron emissions, and thereby vary the intensity of illumination on the phosphor screen. The voltage applied to second grid 16 determines the cathode voltage at which electrons are emitted. Precise repeatable spacing between the cathode, the first grid and the second grid, and precise alignment of apertures in the first and second grids are critical factors. Small misalignments of the first and second grids result in significant distortion of the electron beam from its desired beam path axis. For example, a misalignment of the first and second grid apertures of 0.5 mil (0.0005 inch) produces a 30% axial misalignment of the beam from its desired beam path axis at the limiting aperture and focus assembly of a high resolution electron gun. Beam misalignment and distortion of this type typically results in "banding", which is manifested by the formation of bright lines at intervals in the rastered portion of the CRT screen. Banding reduces the clarity and resolution of a CRT display.

FIG. 2 illustrates a conventional prior art first grid (G1)/second grid (G2) assembly. Cathode assembly 30 comprises cathode sleeve 31 having cathode cap 32 mounted at one end, and cathode 33 at the terminal end thereof providing emission of the electron beam. Cathode assembly 30 is rigidly mounted in non-conductive cathode support member 34 and provided with the necessary support means and electrical connections, as is well known in the art. First grid (G1) assembly 35 comprises a generally flat grid layer 36 with central aperture 37 and grid cap 38 extending generally at a right angle from the periphery of flat grid layer 36. A spacer 39 is preferably provided to locate the cathode assembly with respect to the first grid assembly in the axial and radial directions.

Second grid (G2) 40 is generally flat and has central aperture 41 provided therein and aligned with aperture 37. Second grid 40 is arranged parallel to and spaced a distance from first grid (G1). The anode assembly, which has a surface arranged parallel to and spaced apart from second grid (G2) and a central aperture aligned with apertures 37 and 41 is not shown. As electron beam 15 is emitted from cathode 33 and traverses the multiple grid and anode apertures during operation of the electron gun and CRT, it is important that the apertures in the grid and anode assemblies are properly aligned to assure that the electron beam is not deflected from its predetermined, calculated path.

In conventional, prior art electrode gun assemblies, first and second grids (G1 and G2) are fixed in relationship to one another by means of support pins 42 mounted in glass rods 44, as shown in FIG. 2. A plurality of glass rods 44 (generally four) having support pins bonded therein are generally arranged radially around the periphery of the G1 cap. This arrangement serves to space the grids from one another at the desired axial spacing and to align the grids radially with respect to one another. Glass rods 44 are typically heated, and support pins 42 mounted on both grids are embedded therein while the glass is softened by heating. The G1/G2 assembly is cooled, and central apertures 37 and 41 are subsequently provided in both grids G1 and G2, typically by EDM (electron discharge machine), so that the grid apertures are precisely aligned. The cathode assembly is thereafter mounted in the first grid (G1) assembly. The anode assembly is similarly mounted on a plurality of radially arranged glass rod supports which typically extend substantially the length of the electron gun assembly and provide structural support for many of the electron gun components.

Misalignment of the first (G1) and second (G2) grid apertures 37 and 41, respectively, generally occurs because the grid (G1/G2) assembly shown in FIG. 2 lacks mechanical strength and rigidity. During mounting of support pins 42 in glass rods 44, the glass rods are softened by flame heating to permit embedment. As the assembly is cooled, the metallic support pins and glass rods have different coefficients of thermal expansion, and the metallic support pins contract more than the surrounding glass surface. The support pins become trapped rather than bonded in the glass rods. The grid (G1/G2) assembly therefore does not exhibit good mechanical strength, and movement of the first and second grids relative to one another may occur during and/or after provision of the grid apertures. Movement of the first and second grids relative to one another frequently occurs during mounting of the cathode assembly, which creates substantial misalignments of the grid apertures.

Accordingly, it is an objective of the present invention to provide a grid (G1/G2) assembly which is characterized by mechanical strength and rigidity.

It is another objective of the present invention to provide a grid (G1/G2) assembly in which the grid apertures remain accurately and precisely aligned during assembly and operation of the electron gun and CRT.

It is yet another objective of the present invention to provide methods for reducing deviation and distortion of the electron beam in the electron gun assembly of the CRT.

DISCLOSURE OF THE INVENTION

The present invention provides an integrated grid (G1/G2) assembly which demonstrates significantly improved mechanical strength and rigidity. Enhanced mechanical strength and rigidity of the grid (G1/G2) assembly aids in maintaining accurate and precise alignment of the grid.

The metallic pin and glass rod support system described above with reference to prior art devices and methods is replaced with a non-conductive insulating element and a support collar. The insulating element is mounted, preferably by brazing, on the second grid (G2). The support collar has generally perpendicularly oriented flanges, and one flange is mounted to the outer surface of the first grid (G1) cap. The other flange is mounted, preferably by brazing, to the insulating element to provide a rigid, unitary G1/G2 assembly. The coefficients of thermal expansion of the insulating element, the support collar, and the second (G2) grid are preferably approximately matched so that as the grid assembly is cooled after brazing, all of the support surfaces are in intimate contact to enhance mechanical bonding. The grid apertures are preferably drilled after assembly of the integrated G1/G2 assembly.

According to another aspect of the present invention, a similar type of support arrangement may be employed to mount the anode assembly to the grid (G1/G2) assembly. A second insulating element is mounted, preferably by brazing, on the G2 surface. One flange of a support collar having generally perpendicular flanges is mounted, to the surface of the anode cup, and the other flange is mounted, preferably by brazing, to the insulating element. This provides a unitary grid (G1/G2)/anode structure which demonstrates superior mechanical strength and rigidity. Apertures in the grids and anode may be provided after mounting the components to form an integrated assembly to provide accurately and precisely aligned apertures.

DESCRIPTION OF PREFERRED EMBODIMENTS

Figure 1:
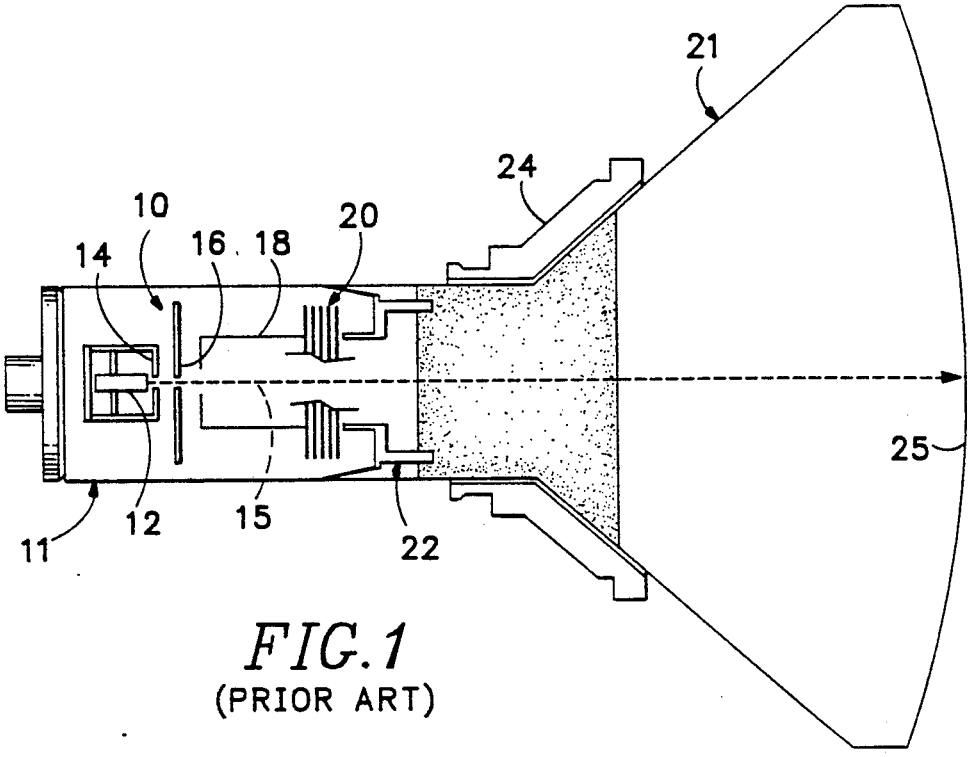
FIG. 1 (PRIOR ART)
FIG. 1 is a schematic longitudinal cross-sectional representation of a magnetically deflected cathode ray tube (CRT) of the type for which the grid assemblies of the present invention are suitable.
Figure 2:
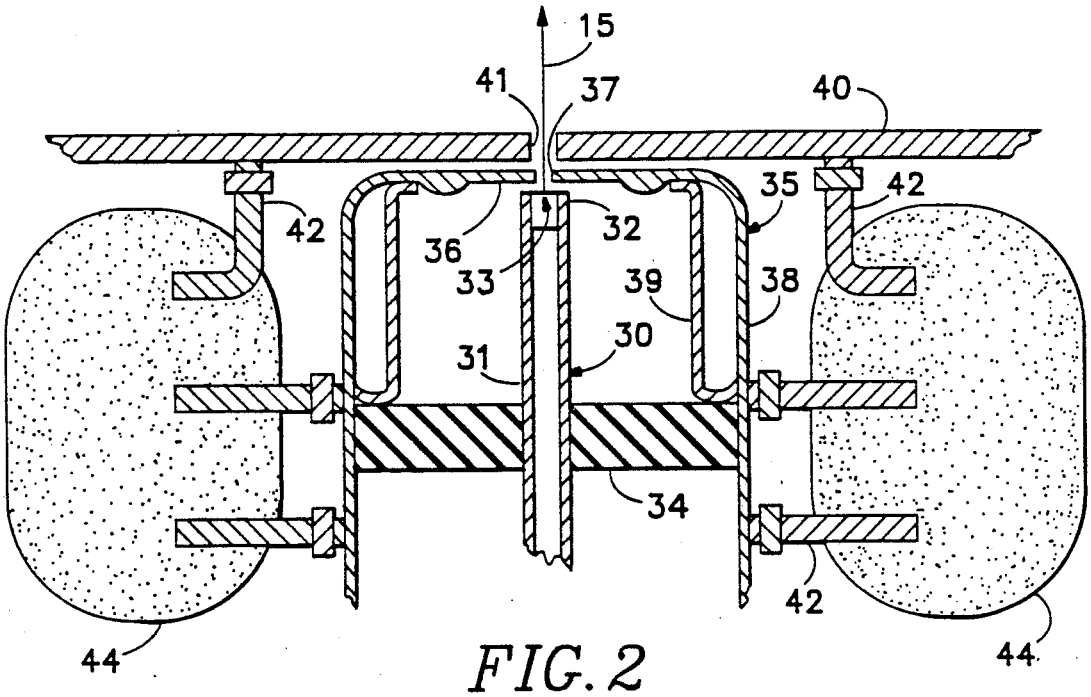
FIG. 2 (PRIOR ART)
FIG. 2 illustrates a prior art grid (G1/G2) assembly intended for use in the electron gun of a CRT apparatus.
Figure 3:
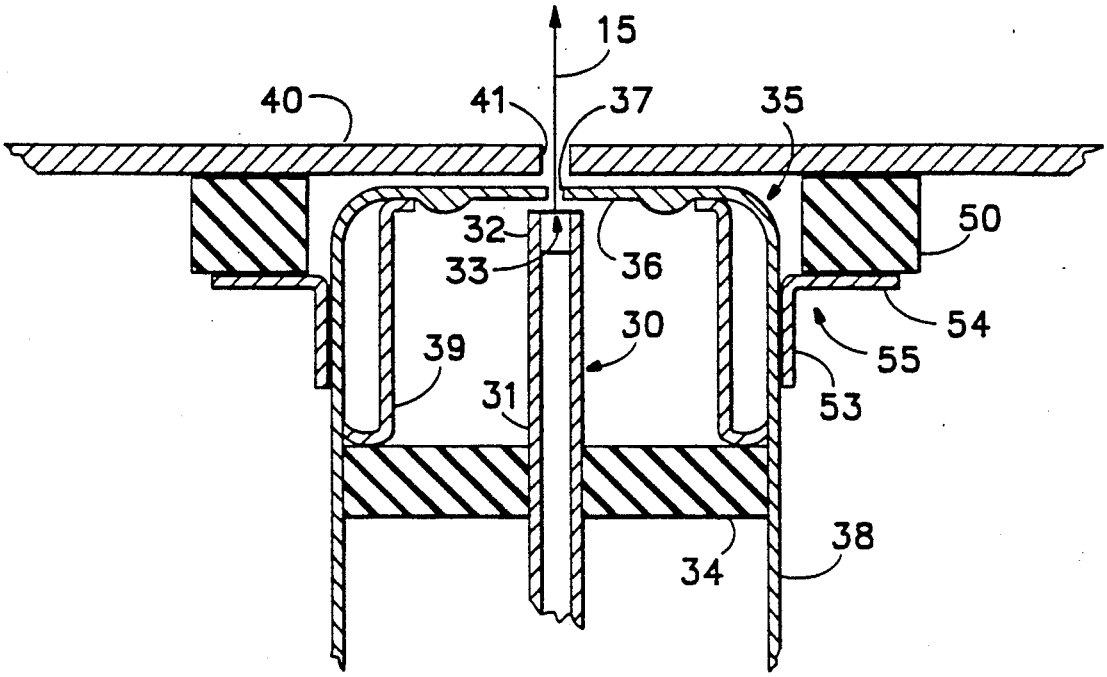
FIG. 3 illustrates a unitary grid (G1/G2) assembly according to the present invention suitable for use in the electron gun of a CRT apparatus.

FIG. 3 illustrates a grid (G1/G2) assembly suitable for use in the electron gun portion of CRTs according to the present invention. Cathode assembly 30 comprises cathode sleeve 31 having cathode cap 32 mounted at one end thereof, and cathode 33 at the terminal end thereof comprising an electron-emissive coating, e.g. a mixture of strontium, barium, and calcium carbonates, deposited on the cathode cap, to emit the electron beam. Cathode assembly 30 is rigidly mounted in non-conductive cathode support member 34 and provided with the necessary mechanical support and electrical connections, as is well known in the art.

First grid (G1) assembly 35 comprises a generally flat grid layer 36, with grid cap 38 extending at substantially right angles from the periphery of flat grid layer 36. Flat grid layer 36 is preferably round, and grid cap 38 is preferably cylindrical. Central aperture 37 is provided in flat grid surface 36 prior to use of the grid assembly in an electron gun apparatus. Grid layer 36 may be "coined," or flattened in its central area to provide a thinner, more rigid layer in proximity to central aperture 37. Spacer 39, a single, continuous annular spacer, is provided to locate the cathode assembly axially with respect to the first grid assembly. The first grid (G1) assembly preferably comprises a conductive, high temperature, vacuum-compatible metal such as a nickel-cobalt-iron alloy known under the trade name "Kovar" or another high temperature, vacuum-compatible metal with similar thermal expansion characteristics. ("Kovar" alloys contain about 28–29% nickel and 17–18% cobalt, the balance being iron. Such alloys are also sold under the trade names "Fernico", "Nilo K", "Dilver P" and "Vacon".) Suitable arrangements for connection of the first grid to a suitable voltage source are well known in the art.

Second grid (G2) 40 is generally flat and is arranged parallel to and spaced a distance from the flat layer of first grid (G1). Suitable configurations and dimensions for second grid (G2) are well known in the art. Central aperture 41 is provided in second grid (G2) and aligned with aperture 37 prior to use of the grid assembly in an electron gun apparatus. Second grid (G2) also preferably comprises a conductive, high temperature, vacuum-compatible metal such as "Kovar" or the like. Arrangements for electrically connecting the second grid (G2) to a suitable voltage source are well known in the art.

According to the present invention, first and second grids (G1) and (G2), respectively, are fixed in relationship to one another by means of non-conductive insulating element 50 and collar element 55. Insulating element 50 is a rigid structure and preferably has a configuration corresponding generally to the peripheral configuration of flat grid layer 36 of first grid (G1). Insulating element 50 is preferably annular, and it comprises a non-conductive ceramic material such as alumina, forsterite, or the like.

Figure 4:
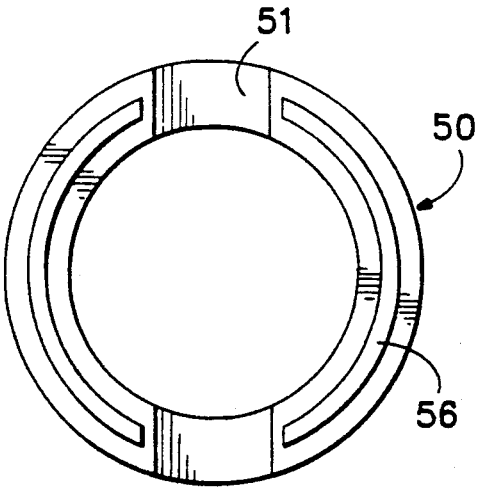
FIG. 4 shows a plan view of a non-conductive insulating element according to the present invention.
Figure 5:
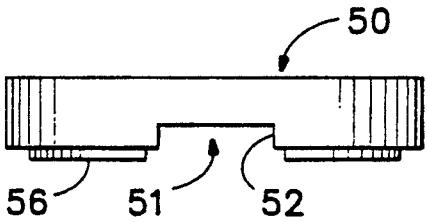
FIG. 5 shows a side view of the insulating element of FIG. 4.

Preferred embodiments of insulating element 50 are illustrated in FIGS. 4 and 5. Insulating element 50 preferably has slot 51 formed therein and extending across the diameter of the annular element. The depth of slot 51, defined by slot wall 52, corresponds to and is slightly larger than the distance between opposing surfaces of grid layer 36 of the first grid (G1) assembly and second grid (G2). Additionally, brazing composition layer 56 may be applied directly to one or both interface surfaces of insulating element 50. The brazing composition preferably comprises silver, which is bonded to the ceramic insulating element using binders. For example, a thin layer of tungsten may be applied directly to the ceramic surface, followed by a thin layer of nickel, and the silver brazing composition may be applied to the binders on the ceramic element. Pre-application of the brazing composition to both component interface surfaces of the insulating member facilitates mounting and attachment of the grid components to form the integrated grid (G1/G2) assembly.

Collar element 55 comprises two flange elements 53 and 54 arranged substantially perpendicularly with respect to one another. According to preferred embodiments wherein insulating element 50 is annular, collar element 55 is also annular. The inner diameter of annular flange 53 is sized to correspond approximately to the outer diameter of G1 grid cap 38. Collar element 55 preferably comprises a material having a coefficient of thermal expansion corresponding approximately to that of insulating element 50, such as "Kovar" or the like. "Kovar" and 85% alumina have similar coefficients of thermal expansion, and therefore are preferred for use together. Likewise, forsterite and titanium have similar coefficients of thermal expansion and may be used together. The first and second grids (G1 and G2) and the collar element are preferably metallic, while the insulating element is preferably ceramic.

Insulating element 50 and flange 54 of collar element 52 are preferably joined by brazing, using a high temperature brazing composition, such as silver. Insulating element 50 is similarly preferably joined to second grid (G2) by brazing. Suitable brazing techniques are well known in the art. Other methods which produce joints having comparable mechanical strength and rigidity are also suitable. Use of high temperature brazing to join components having similar coefficients of thermal expansion promotes strong mechanical bonding, and provides integrated grid assemblies demonstrating improved mechanical strength and structural rigidity.

The present invention further includes methods for assembling the integrated grid (G1/G2) assemblies described above. As described above with reference to prior art devices, assembly proceeds generally as follows: the first and second grid components are preferably fixed in relation to one another; central apertures are drilled in the first and second grid components; and the cathode assembly is subsequently mounted in the first grid component. The methods of the present invention depart from the prior art methods, however, in several important respects.

Opposed surfaces of insulating element 50 are positioned and mounted, preferably by brazing, between one surface of the second grid and one flange of collar element 55. Each joint may be brazed independently or alternatively, brazing of the insulating element to both the second grid and the collar element may be achieved simultaneously. For example, when the brazing composition is pre-applied to both interface surfaces of the insulating member, the second grid (G2), insulating element 50, and collar element 55 may be aligned and fixed in position, then heated to brazing temperatures. Brazed joints are thereby provided at the G2/insulating element and collar element/insulating element interfaces. Grid 38 is thereafter positioned adjacent and within flange 53 of the collar element, and the outer surface of grid cap 38 is fixedly mounted to the collar element by suitable means, such as welding.

Proper axial alignment of the grid components to provide the desired space between grid surfaces is preferably provided by sliding a spacer member into slot 51 of insulating member 50 after the insulating member has been mounted to the second grid (G2) and the collar element. The spacer member corresponds to and is slightly smaller than the depth of slot wall 52, which in turn corresponds to the desired spacing between the first and second grids. The first grid (G1) is then positioned inside flange 54 of collar element 55, and moved toward the second grid until flat grid layer 36 contacts the spacer member. Flange 53 is rigidly mounted to grid cap 38 at this position, and the spacer member is removed. In this fashion, accurate spacing may be provided between the first and second grids.

Figure 6:
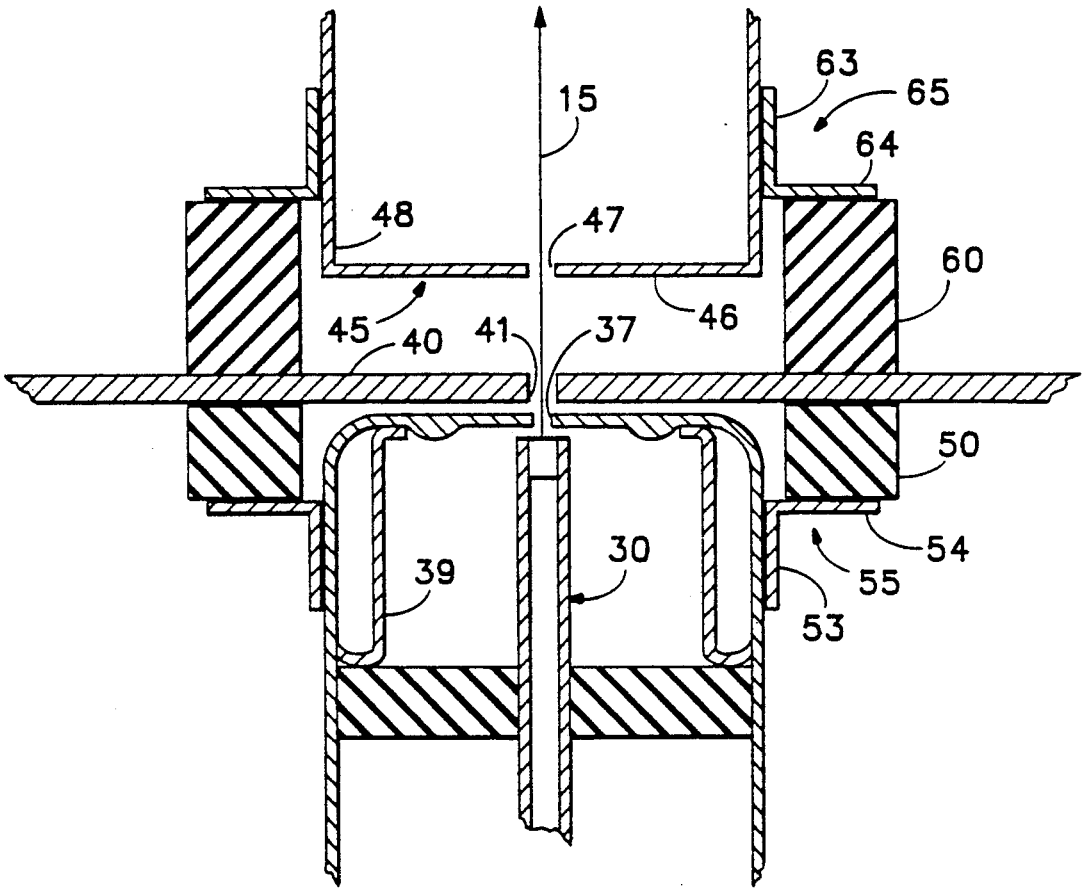
FIG. 6 illustrates an integrated grid (G1/G2)/anode assembly according to the present invention.

FIG. 6 illustrates another preferred embodiment of the grid assembly of the present invention wherein the anode assembly is rigidly mounted to the G1/G2 assembly in much the same way as the grids are mounted to one another. As shown in FIG. 6, anode assembly 45 comprises a substantially flat layer 46, with anode cap 48 extending at substantially right angles from the periphery of flat anode layer 46. Flat anode layer 46 is preferably round, and anode cap 48 is preferably cylindrical. Central aperture 47 is provided in anode layer 46 prior to use of the grid/anode assembly in an electron gun apparatus. Anode assembly 45 preferably comprises a conductive, high temperature, vacuum-compatible metal such as "Kovar" or the like. Suitable arrangements for connection of the anode assembly to voltage sources is well known in the art.

Anode assembly 45 is fixed in relation to the G1/G2 grid assembly by means of second non-conductive insulating element 60 and second collar element 65. Second insulating element 60 is preferably annular, and it preferably comprises a non-conductive ceramic material such as alumina. Second insulating element 60 is generally longer than insulating element 50, since the anode assembly is generally spaced farther from the second grid (G2) than is the first grid (G1) assembly, and has to withstand a voltage substantially higher than that of the G1 assembly. Second insulating element 60 may be provided with a slot for accurately spacing anode layer 46 from the second grid (G2) during assembly, and brazing composition layers similar to those described above with reference to insulating element 50.

Second collar element 65 comprises two annular flange elements 63 and 64 arranged substantially perpendicularly with respect to one another. The inner diameter of flange 53 is sized to correspond approximately to the outer diameter of anode cap 48. Second collar element 65 preferably comprises a material having a coefficient of thermal expansion corresponding approximately to that of second insulating element 50, such as "Kovar" or the like. Second insulating element 60 is preferably joined to flange 64 of second collar element 65 and second grid (G2) by brazing to provide an integrated G1/G2/anode assembly having increased mechanical strength and structural rigidity.

While in the foregoing specification this invention has been described in relation to certain preferred embodiments thereof, and many details have been set forth for purposes of illustration, it will be apparent to those skilled in the art that the invention is susceptible to additional embodiments and that certain of the details described herein may be varied considerably without departing from the basic principles of the invention.

We claim:

1. A grid assembly for use in an electron gun apparatus comprising:

a first grid (G1) having a grid layer and a cap portion extending substantially perpendicularly from the periphery of said grid layer;

a second grip (G2) comprising a grid surface arranged parallel to said grid layer of said first grid (G1) and spaced a distance therefrom;

an insulating element having first and second faces oriented parallel to one another, said first face rigidly mounted on said grid surface of said second grid element; and a collar element comprising first and second flanges oriented substantially perpendicular to one another, said first flange rigidly mounted on said second face of said insulating element, and said second flange rigidly mounted to said cap portion of said first grid (G1), said collar element comprising a material having a coefficient of thermal expansion substantially equivalent to that of the said insulating element.

2. A grid assembly according to claim 1, wherein said grid layer of said first grid (G1) and said grid surface of said second grid (G2) have aligned apertures penetrating a central portion thereof.

3. A grid assembly according to claim 1, wherein said grid layer of said first grid (G1) is round, and said cap portion of said first grid (G1) and said first and second flanges of said collar element are annular.

4. A grid assembly according to claim 1, wherein said insulating element is annular.

5. A grid assembly according to claim 1, wherein said first face of said insulating element has a slot formed therein, and said slot has a depth slightly larger than said distance between said grid layer of said first grid (G1) and said grid surface of said second grid (G2).

6. A grid assembly according to claim 1, wherein said first face of said insulating element is rigidly mounted on said grid surface of said second grid (G2) by brazing.

7. A grid assembly according to claim 1, wherein said first flange of said collar element is rigidly mounted on said second face of said insulating element by brazing.

8. A grid assembly according to claim 1, wherein said second flange of said collar element is rigidly mounted to said cap portion of said first grid (G1) by welding.

9. A grid assembly according to claim 1, wherein said collar element comprises a metallic material and said insulating element comprises a ceramic material.

10. A grid assembly according to claim 9, wherein said collar element and said second grid comprise a nickel-cobalt-iron alloy and said insulating element comprises alumina.

11. A grid assembly according to claim 1, additionally comprising a cathode mounted within said first grid (G1) and positioned along a generally central longitudinal axis of said first grid.

12. A grid assembly according to claim 1, additionally comprising:

a second insulating element having first and second faces oriented parallel to one another, said first face rigidly mounted on a grid surface of said second grid (G2);

a second collar element comprising first and second flanges oriented substantially perpendicular to one another, said first flange rigidly mounted on said second face of said second insulating element; and an anode having a grid layer and a cap portion extending substantially perpendicularly from the periphery of said grid layer, said cap portion of said anode rigidly mounted to said second flange of said second collar element.

13. A method for mounting a plurality of grids to form a grid (G1/G2) assembly of use in an electron gun apparatus comprising:

mounting a second grid (G2) generally centrally on a first face of an insulating element;

mounting a first flange of a collar element on a second face of said insulating element, said second face of said insulating element oriented substantially parallel to said first face;

inserting a spacer member through a slot provided said insulating element adjacent said second grid (G2);

moving a first grid (G1) within a second flange of said collar element oriented substantially perpendicular to said first flange toward said second grid (G2) until a grid layer of said first grid contacts said spacer member; and mounting a cap portion of said first grid extending substantially perpendicular from said grid layer to said second flange of said collar element, so that said grid layer of said first grid is substantially parallel to and spaced a distance from a grid surface of said second grid.

14. A method according to claim 13, wherein said second grid and collar element are mounted on said insulating element by brazing.

15. A method according to claim 14, wherein a brazing composition is located between said second grid and said insulating element, and said first flange of said collar element and said insulating element, and said second grid and collar element are brazed to said insulating element simultaneously by heating the assembly to brazing temperatures.

16. A method according to claim 13, additionally comprising providing aligned central apertures in said second grid (G2) and said grid layer of said first grid (G1) after said grids have been mounted relative to one another.

17. A method according to claim 16, additionally comprising mounting a cathode assembly along a generally central longitudinal axis of said first grid (G1), with a terminal portion of said cathode assembly aligned with said central apertures in said first and second grids.

18. A grid assembly for use in an electron gun apparatus comprising:

a first grid (G1) having a grid layer and a cap portion extending substantially perpendicularly form the periphery of said grid layer;

a second grid (G2) comprising a grid surface arranged parallel to said grid layer of said first grid (G1) and spaced a distance therefrom;

an insulating element having first and second faces oriented parallel to one another, said first face rigidly mounted on said grid surface of said second grid element and having a slot formed therein with a depth corresponding approximately to the distance between said grid layer of said first grid (G1) and said grid surface of said second grid (G2); and a collar element comprising first and second flanges oriented substantially perpendicular to one another, said first flange rigidly mounted on said second face of said insulating element, and said second flange rigidly mounted to said cap portion of said first grid (G1).

* * * * *